US009859656B2

(12) United States Patent
Mitri et al.

(10) Patent No.: US 9,859,656 B2
(45) Date of Patent: Jan. 2, 2018

(54) APPARATUS FOR PREVENTION OF PLUG SLIPPAGE FROM A STANDARD ELECTRICAL SOCKET

(71) Applicant: Snug Plug LLC, Las Vegas, NV (US)

(72) Inventors: Salim Mitri, Modesto, CA (US); Joel Switzer, Concord, CA (US)

(73) Assignee: Snug Plug LLC, Las Vegas, NV (US)

( * ) Notice: Subject to any disclaimer, the term of this patent is extended or adjusted under 35 U.S.C. 154(b) by 0 days.

(21) Appl. No.: 15/132,240

(22) Filed: Apr. 19, 2016

(65) Prior Publication Data

US 2017/0302025 A1 Oct. 19, 2017

(51) Int. Cl.

| | |
|---|---|
| ***H01R 13/639*** | (2006.01) |
| ***H01R 13/635*** | (2006.01) |
| ***H01R 24/76*** | (2011.01) |
| *H01R 103/00* | (2006.01) |

(52) U.S. Cl.

CPC ..... *H01R 13/6395* (2013.01); *H01R 13/635* (2013.01); *H01R 24/76* (2013.01); *H01R 2103/00* (2013.01)

(58) Field of Classification Search

CPC ..... H01R 13/6395

See application file for complete search history.

(56) References Cited

U.S. PATENT DOCUMENTS

| | | | | |
|---|---|---|---|---|
| 2,869,098 A * | 1/1959 | Sauer | H01R 13/6395 | 439/353 |
| 2,932,811 A * | 4/1960 | Abraham | H01R 13/443 | 439/144 |
| 3,659,248 A * | 4/1972 | Mann | H01R 13/447 | 439/144 |
| 3,686,616 A * | 8/1972 | Bowerman | H01R 13/443 | 24/511 |
| 4,424,407 A * | 1/1984 | Barbic | H01R 13/447 | 174/67 |
| 5,320,542 A * | 6/1994 | Cheng | H01R 13/443 | 174/67 |
| D359,726 S * | 6/1995 | Umeya | H01R 13/443 | D13/199 |
| 5,762,515 A * | 6/1998 | Mele | H01R 13/6392 | 439/367 |
| 6,051,788 A * | 4/2000 | Nichols | H01R 13/447 | 174/67 |
| 6,769,930 B1 * | 8/2004 | McDevitt, Jr. | H01R 13/6395 | 439/373 |
| 7,722,380 B1 * | 5/2010 | West | H01R 13/6395 | 439/373 |
| 9,711,900 B1 * | 7/2017 | Brown | H01R 13/6395 | |
| 2002/0155754 A1 * | 10/2002 | De'Longhi | H01R 13/6205 | 439/519 |
| 2016/0104968 A1 * | 4/2016 | Bartholomew | H01R 13/6395 | 439/310 |

* cited by examiner

*Primary Examiner* — James Harvey

(74) *Attorney, Agent, or Firm* — Cann IP Law PLLC; Ryan J. Cann, Esq.

(57) ABSTRACT

The present invention is generally related to an apparatus for use with an electrical outlet to improve electrical device fit and more particularly related to an apparatus for providing a tighter fit for electrical power blades of the plug portion of an electric powered device within a standard electrical outlet so as to prevent the electrical power blades from slipping out of the electrical outlet during use of the electrical device.

6 Claims, 2 Drawing Sheets

APPARATUS FOR PREVENTION OF PLUG SLIPPAGE FROM A STANDARD ELECTRICAL SOCKET

BRIEF DESCRIPTION OF THE INVENTION

The present invention is generally related to an apparatus for use with an electrical outlet to improve electrical device fit and more particularly related to an apparatus for providing a tighter fit for electrical power blades of the plug portion of an electric powered device within a standard electrical outlet so as to prevent the electrical power blades from slipping out of the electrical outlet during use of the electrical device.

CROSS-REFERENCES TO RELATED APPLICATIONS

Not applicable.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

The present invention is generally related to an apparatus for use with an electrical outlet to improve electrical device fit. Widely utilized electrical power technology involves a female portion referred to as a socket, having two or more slots (or holes), and a male portion referred to as a plug having protruding blades (or pins). The arrangement of the blades on the plug matches the arrangement of the slots on the socket so that the plug may be inserted into the socket and thus engage the blades with electrical contacts located within an inner portion of the socket. Sockets are designed with such inner positioned contacts to prevent exposure of bare energized contacts for obvious safety reasons.

The North American standard for electrical outlets is 120 volts at a frequency of 60 Hz, and for standard residential use is arranged with two slots in parallel for reception of plugs utilizing two blades in parallel. A third blade, and corresponding third slot, may be positioned below and in between the two parallel blades/slots; this third blade/slot is utilized for grounding and is not included in all standard residential electrical outlets assemblies.

The standard North American electrical outlet arrangement of two parallel blades/slots has a significant drawback in that overtime, the blades can slip out of the slots to the point where the plug either completely or partially falls out of the socket. When the blades fall out of the socket, the electrical connection is lost and the electrical device is temporarily powerless and therefore unusable. This problem can occur for any type of electrically powered device, but tends to occur frequently when the electrical device is a handheld device that is movable by the user during use. For example, when a vacuum cleaner device is being used the user often finds that he or she has accidentally pulled the plug at least partially out of the socket during standard vacuuming activity, which can render the vacuum cleaner useless until the plug is reinserted into the socket. Another common example of this blade-slippage problem is when a smartphone user is attempting to recharge the user's smartphone while simultaneously using the smartphone. In such a situation, the user often accidentally pulls the charging cord plug out of the electrical outlet socket. This occurs frequently because smartphone charging plugs typically only utilize two blade configurations which can easily slip out of socket holes with only minimal force applied by the user.

There is a need for technology to overcome this common electrical plug slippage problem. Many attempts and techniques for solving this problem are known in the prior art, but all such known solutions have major drawbacks in that they are either difficult for a user to use or they are complex and/or expensive apparatus that must be mechanically attached to existing electrical socket assemblies.

For example, U.S. Pat. No. 3,659,248 to Mann et al. discloses a hinge which may be mechanically attached to the faceplate of an electrical socket. The Mann et al. hinge functions to engage the plug of an electrical device so as to prevent the plug from slipping out of the socket. But such a hinge must be mechanically attached to the socket and so is both a cumbersome and expensive solution to the above described plug slippage problem. A similarly complex mechanical solution is disclosed in U.S. Pat. No. 4,925,396 to Grover. Grover discloses a complex sliding latch plate in combination with springs that make the plug-socket connection tight. The Grover solution is relatively expensive in that it requires manufacture of many interconnected mechanical parts, and thus is not practical for widespread use. Another similarly mechanically complex solution is disclosed in U.S. Pat. Application No. 2002/0155754 to De'Longhi. De'Longhi discloses a device that utilizes a magnetized connection between electrical device plugs and electrical outlet sockets.

Several other solutions in the prior art involve directly holding the plug in place with apparatus that may be formed of plastic or plastic-like materials. U.S. Pat. No. 4,424,407 to Barbic discloses an electrical outlet safety cover that includes a strip with holes for looping through the electrical device plug's cord and thereby stabilizing the plug within the socket to, among other alleged advantages, keep the plug from slipping out of the socket. It is possible to form this Barbic strip from plastic, but the Barbic disclosure requires several additional components to stabilize the strip itself, making the Barbic solution equally complex and impractical. Furthermore, the Barbic strip stabilizes the plug in a wholly different manner than the present invention (as described herein) because the Barbic strip does not protrude into the slots of the socket, is not U-shaped, and does not include nodules for gripping a faceplate of the socket. Another prior art solution is disclosed in U.S. Pat. No. 5,762,515 to Mele. The Mele solution involves an elastically expandable tube which is fitted around the plug and the electrical socket in order to secure the plug-socket connection and prevent slippage. The Mele disclosure cannot be used with standard residential wall-mounted (or floor-mounted) electrical outlets because the Mele disclosure requires the socket to be protruding in some way so as to allow the disclosed elastically expandable tube to fit over and around a portion of the socket. Standard sockets, which are flush against a wall or a floor, do not provide such a protruding portion. Furthermore, as with the Barbic solution, the Mele solution does not protrude into the slots of the socket, is not U-shaped, and does not include nodules for gripping a faceplate of the socket.

As disclosed, the prior art solutions solve the above described plug slippage problem in very different ways than the present invention; they are complex, relatively expensive, and impractical. There is, therefore, a need for a simpler apparatus for prevention of plug slippage from standard electrical sockets. The present invention solves this problem in a simple, elegant, and inexpensive way, allowing the present invention to be widely utilized with standard electrical devices and standard electrical outlets.

DETAILED DESCRIPTION OF THE INVENTION

The present invention is an apparatus for use in an electrical socket to substantially prevent a plug from slipping out of the electrical socket. The herein disclosed apparatus, in an exemplary embodiment, is a U-shaped body having two arms for insertion into the two slots of a standard electrical socket (which may be referred to as an electrical outlet) and a face plate portion that connects the two arms of the U-shaped body. In an exemplary embodiment, each of the two arms are formed so as to include a plurality of nodules for hooking a back portion of a cover (or a face plate) of the electrical socket.

Figure 1B:
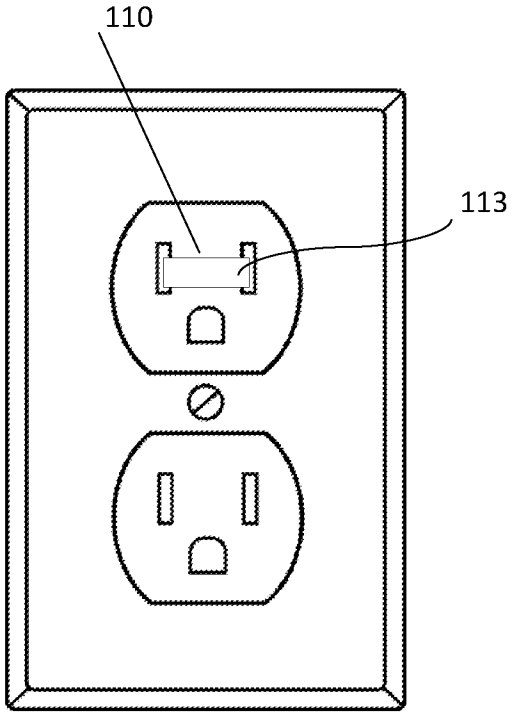
FIG. 1B illustrates an apparatus for prevention of plug slippage from a standard electrical socket in accordance with the present invention, as positioned within the standard electrical socket during use.
Figure 1A:
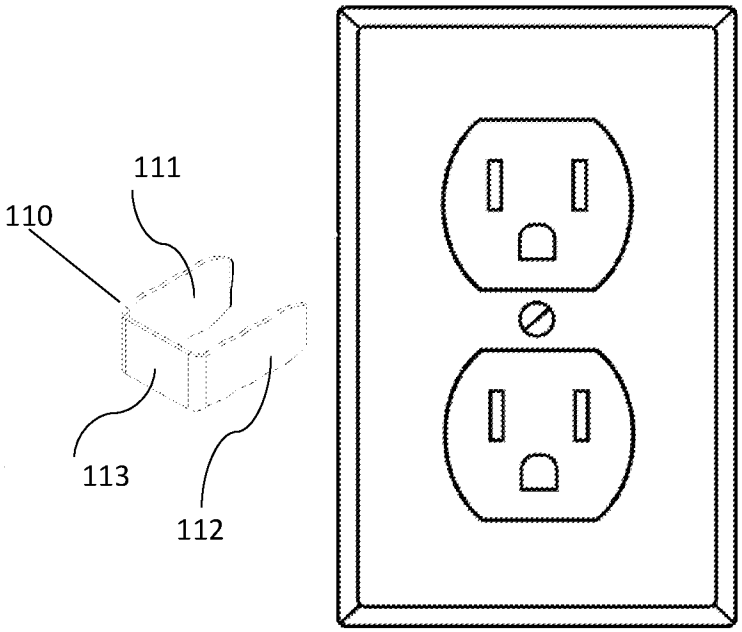
FIG. 1A illustrates a general overview of an apparatus for prevention of plug slippage from a standard electrical socket in accordance with the present invention, in relation to a standard electrical socket.

Referring to FIG. 1A and FIG. 1B, the herein disclosed apparatus for use in an electrical socket to substantially prevent a plug from slipping out of the electrical socket is shown just before insertion into a standard electrical socket (FIG. 1A) and after insertion into the electrical socket (FIG. 1B). FIG. 1B shows, in other words, the herein disclosed apparatus in use. Apparatus for prevention of plug slippage 101 is comprised of U-shaped body 110. U-shaped body 110 may be formed of plastic, for example. In an exemplary embodiment, U-shaped body 110 may be formed from extruded plastic with perforations included in the plastic so as to allow the extruded plastic to be bent into the desired U-shaped body 110. In another exemplary embodiment, U-shaped body 110 may be formed of injection molded plastic, directly producing the desired U-shape. Alternatively, U-shaped body 110 may be formed of any other material that is pliable enough to be suitable for the present invention. While U-shaped body 110 is referred to as "U-shaped", component 110 may in fact be more square-like at its corners and therefore not exactly shaped like the letter U. Such a configuration is intended to be included in the phrase "U-shaped".

While the herein disclosed apparatus is in use (positioned partially within the socket with its two arms inserted into the slots of the socket), a user is still able to insert an electrical device's plug into the socket. The arms of the herein disclosed apparatus are of such dimensions that the blades (which may be referred to as prongs or pins) of the plug are still able to fit into the slots of the socket and make the necessary contact with the energized contacts of the standard electrical socket.

U-shaped body 110 has a first arm 111, a second arm 112, and a face plate portion 113. First arm 111 and second arm 112 are formed such that they are able to be inserted into the two parallel slots of a standard electrical socket. The two parallel slots can be seen in FIG. 1A. During use, first arm 111 may be inserted into a first slot of the electrical socket and second arm 112 may be inserted into a second slot of the electrical socket. Face plate portion 113 of U-shaped body 110 connects first arm 111 and second arm 112, and is substantially perpendicular to first arm 111 and second arm 112. While in use, as illustrated in FIG. 1B, face plate portion 113 may be flush, or substantially flush, with the electrical socket and in parallel with the wall (or floor) supporting the electrical socket.

Figure 2A:
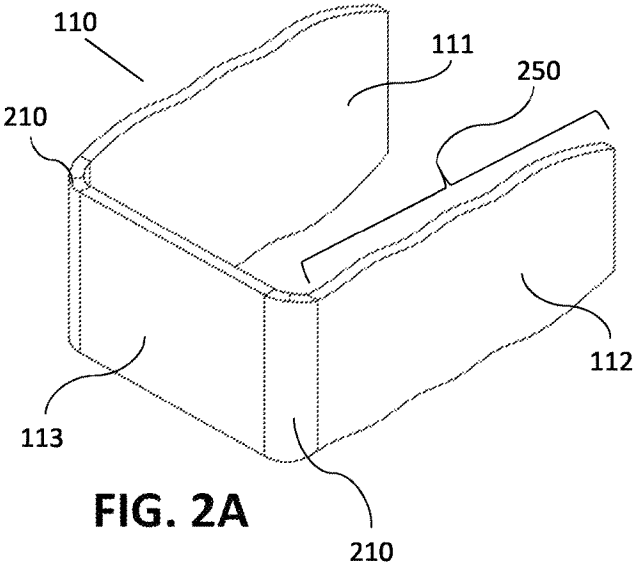
FIG. 2A illustrates an isometric view of an embodiment of an apparatus for prevention of plug slippage from a standard electrical socket in accordance with the present invention.
Figure 2B:
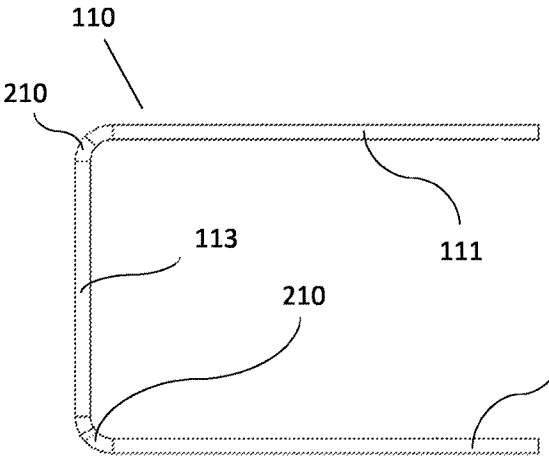
FIG. 2B illustrates an overhead view of an embodiment of an apparatus for prevention of plug slippage from a standard electrical socket in accordance with the present invention.
Figure 2C:
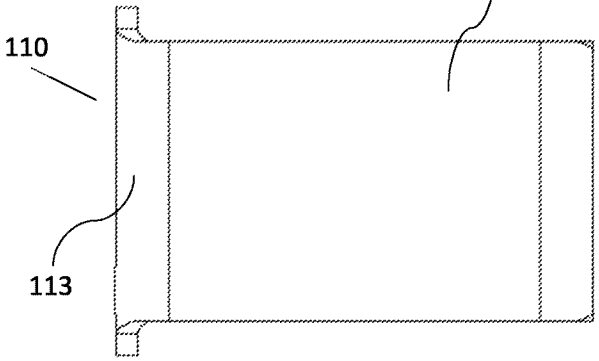
FIG. 2C illustrates a side view of an embodiment of an apparatus for prevention of plug slippage from a standard electrical socket in accordance with the present invention.

Referring to FIGS. 2A, 2B, 2C, and 2D, U-shaped body 110 is again shown with first arm 111, second arm 112, and face plate portion 113. U-shaped body 110 may also include corners 210. As is apparent in FIG. 2C, face plate portion 113 may be of a greater height than first arm 111 (not seen in this view) and second arm 112 (which can be seen in this view). In an exemplary embodiment, face plate portion 113 may be approximately 0.340 inches in height (and approximately 0.412 inches in width), while first arm 111 and second arm 112 may be approximately 0.274 inches in height. In an exemplary embodiment, as seen in FIG. 2B, first arm 111 and second arm 112 may be approximately 0.617 inches in length, and face plate portion 113 may be approximately 0.412 inches in width. In this exemplary embodiment, the thickness of U-shaped body 110 may be approximately 0.020 inches. U-shaped body 110 may be of uniform thickness, or may be approximately uniform in thickness except for corners 210 which may be somewhat thinner than the remaining portions of U-shaped body 110 due to deformation of the material caused by bending at corners 210.

As discussed above, U-shaped body 110 may be formed in at least two differing ways which may result in variations of corners 210. U-shaped body 110 may be formed of injection molded plastic in one piece, for example, in which case corners 210 may be formed as rounded corners with a predetermined radius. For example, corners 210 may be formed as rounded corners having a radius of approximately 0.050 inches. Alternatively, U-shaped body 110 may be formed of an extruded sheet of plastic, for example. In this example, face place portion 113, first arm 111, and second arm 112 are all formed on a contiguous sheet of plastic (which may be of approximately 0.020 inches in thickness). Continuing with this example, in this case corners 210 may be formed by perforating the plastic at corners 210, thus allowing a user or a manufacturer to bend the contiguous plastic sheet at corners 210 to bend first arm 111 and second arm 112 into alignment to create U-shaped body 110. In such an example, corners 210 may be approximately 90 degree angles, at least until the herein disclosed apparatus is put into use in an electrical socket at which time U-shaped body 110 will bend somewhat and create non-uniform curves at corners 210.

Figure 2D:
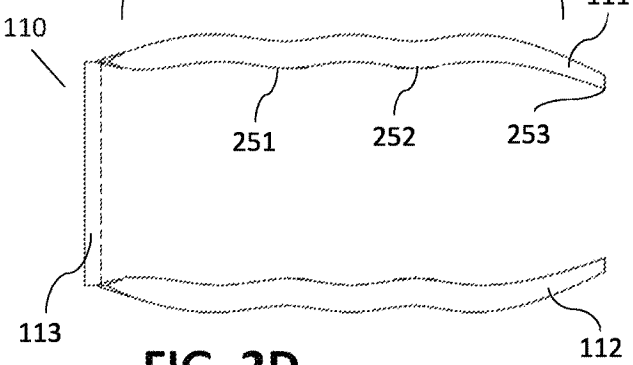
FIG. 2D illustrates an overhead view of an embodiment of an apparatus for prevention of plug slippage from a standard electrical socket in accordance with the present invention.

As can be seen in FIG. 2A and FIG. 2D, in an exemplary embodiment of the present invention, first arm 111 and second arm 112 may form a plurality of nodules 250 throughout the entire length, or a portion of the length, of first arm 111 and second arm 112. The purpose of nodules 250 is so that after first arm 111 is inserted into a first slot of the electrical socket and second arm 112 is inserted into a second slot of the electrical socket, nodules 250 can hook, or catch, onto the back of the electrical socket's face plate. In this way, more friction is created between the arms of the herein disclosed apparatus and the corresponding slots in the electrical socket because the arms may no longer be in exact parallel with the slots. In this way, nodules 250 may improve the performance of the herein disclosed apparatus for prevention of plug slippage from a standard electrical socket. It should be noted, however, that the herein disclosed apparatus may function at an acceptable level even without nodules 250, and as such first arm 111 and second arm 112 may be substantially straight in some embodiments; such embodiments are intended to be included herein.

As will be apparent to those skilled in the art, Nodules 250 may be formed in a number of different way, all of which are intended to be included herein. For example, nodules 250 may be formed by manufacturing (or machining) a number of cuts into the plastic, or other material, forming first arm 111 and second arm 112. Alternatively, first arm 111 and second arm 112 may be formed to embody a wave-like form, as is apparent in FIG. 2D. An exemplary embodiment of the herein disclosed apparatus may include such a wave-like form for arms 111 and 112 such that a first nodule 251 is formed approximately 0.192 inches from face plate portion 113, a second nodule 252 is formed approximately 0.342 inches from face plate portion 113 (and 0.150 inches from first nodule 251), and a third nodule 253 is formed at the far end of first arm 111 and second arm 112.

The herein disclosed apparatus has been described, in certain embodiments, as having particular dimensions. The dimensions provided may be ideal under certain conditions. But the dimensions provided are intended only as being exemplary, and not limiting. Those skilled in the art will recognize that the herein disclosed apparatus for prevention of plug slippage from standard electrical sockets can be formed in any number of dimensions to serve the same purpose, and all such dimensions are intended to be included herein. Furthermore, any specific dimensions provided are approximate dimensions.

The purpose of the herein disclosed apparatus, as described throughout, is to substantially prevent slippage of a plug from a standard electrical socket. By using the disclosed apparatus, a plug is made to fit much more snugly within a socket. But the plug will not be completely prevented from exiting the socket, and in fact a user may still be able to remove the plug by applying substantial force to the plug. This is by design because a user of the herein disclosed apparatus may still wish to remove the plug from the socket when the user is finished using the electrical device. In other words, the apparatus is not meant to make the plug-socket connection permanent, and is only meant to make the plug-socket connection more secure and less prone to accidental slippage. The apparatus is described as "substantially" preventing slippage, and that phrase includes preventing a plug from accidentally, or unintentionally, slipping partially (to the extent that electrical connection is lost) or fully out of the socket.

While the present invention has been illustrated and described herein in terms of a preferred embodiment and several alternatives, it is to be understood that the apparatus described herein can have a multitude of additional uses and applications. Accordingly, the invention should not be limited to just the particular description and various drawing figures contained in this specification that merely illustrate a preferred embodiment and application of the principles of the invention.

What is claimed is:

1. An apparatus for use in an electrical socket to substantially prevent a plug from slipping out of the electrical socket, comprising: a U-shaped body having a first arm for insertion into a first slot of the electrical socket and a second arm for insertion into a second slot of the electrical socket, the u-shaped body further having a face plate portion connecting the first arm and the second arm;

the first arm and the second arm each have a first nodule, a second nodule, and a third nodule; and the first nodule is located approximately 0.192 inches from the face plate portion, the second nodule is located approximately 0.342 inches from the face plate portion, and the third nodule is located at an end of each of the first arm and the second arm.

2. An apparatus for use in an electrical socket to substantially prevent a plug from slipping out of the electrical socket, comprising: a U-shaped body having a first arm for insertion into a first slot of the electrical socket and a second arm for insertion into a second slot of the electrical socket, the u-shaped body further having a face plate portion connecting the first arm and the second arm;

the first arm is approximately 0.617 inches in length and the second arm is approximately 0.617 inches in length.

3. An apparatus for use in an electrical socket to substantially prevent a plug from slipping out of the electrical socket, comprising:

a U-shaped body approximately 0.020 inches thick and having a first arm of approximately 0.617 inches in length and approximately 0.274 inches in height for insertion into a first slot of the electrical socket and a second arm of approximately 0.617 inches in length and approximately 0.274 inches in height for insertion into a second slot of the electrical socket, the u-shaped body further having a face plate portion of approximately 0.412 inches in width and approximately 0.340 inches in height and connecting the first arm and the second arm, and wherein the first arm forms a first plurality of nodules and wherein the second arm forms a second plurality of nodules.

4. The apparatus as recited in claim 3, wherein the first plurality of nodules includes a first nodule located approximately 0.192 inches away from the face plate portion, a second nodule located approximately 0.342 inches away from the face plate portion, and a third nodule located substantially at the end of the first arm, and wherein the second plurality of nodules includes a first nodule located approximately 0.192 inches away from the face plate portion, a second nodule located approximately 0.342 inches away from the face plate portion, and a third nodule located substantially at the end of the second arm.

5. An apparatus, comprising:

a U-shaped body approximately 0.020 inches thick and having a first arm of approximately 0.617 inches in length and approximately 0.274 inches in height, and a second arm of approximately 0.617 inches in length and approximately 0.274 inches in height, the u-shaped body further having a face plate portion of approximately 0.412 inches in width and approximately 0.340 inches in height and connecting the first arm and the second arm, and wherein the first arm forms a first plurality of nodules and wherein the second arm forms a second plurality of nodules.

6. The apparatus as recited in claim 5, wherein the first plurality of nodules includes a first nodule located approximately 0.192 inches away from the face plate portion, a second nodule located approximately 0.342 inches away from the face plate portion, and a third nodule located substantially at the end of the first arm, and wherein the second plurality of nodules includes a first nodule located approximately 0.192 inches away from the face plate portion, a second nodule located approximately 0.342 inches away from the face plate portion, and a third nodule located substantially at the end of the second arm.

* * * * *